US006599593B1

(12) United States Patent
Niu et al.

(10) Patent No.: US 6,599,593 B1
(45) Date of Patent: Jul. 29, 2003

(54) HIGH EFFICIENCY PRINT MEDIA PRODUCTS AND METHODS FOR PRODUCING THE SAME

(75) Inventors: Bor-Jiunn Niu, San Diego, CA (US); Yubai Bi, San Diego, CA (US)

(73) Assignee: Hewlett-Packard Development Company, L.P., Houston, TX (US)

( * ) Notice: Subject to any disclaimer, the term of this patent is extended or adjusted under 35 U.S.C. 154(b) by 156 days.

(21) Appl. No.: 09/662,450

(22) Filed: Sep. 14, 2000

(51) Int. Cl.[7] ..... B41M 5/00

(52) U.S. Cl. ..... 428/32.25; 428/32.24; 428/32.28

(58) Field of Search ..... 428/195, 212, 428/331, 522, 474.4, 423.1, 32.24, 32.25, 32.28; 347/105

(56) References Cited

U.S. PATENT DOCUMENTS

| | | | | |
|---|---|---|---|---|
| 4,329,698 | A | 5/1982 | Smith | 346/140 R |
| 4,391,850 | A | 7/1983 | Shanton | 427/150 |
| 4,440,827 | A | 4/1984 | Miyamoto et al. | 428/327 |
| 4,446,174 | A | 5/1984 | Maekawa et al. | 427/261 |
| 4,474,847 | A | 10/1984 | Schröder et al. | 428/323 |
| 4,567,096 | A | 1/1986 | Piltingsrud et al. | 428/315.5 |
| 4,623,557 | A | 11/1986 | Yamori et al. | 427/44 |
| 4,642,247 | A | 2/1987 | Mouri et al. | 427/214 |
| 4,749,291 | A | 6/1988 | Kobayashi et al. | 400/124 |
| 4,771,295 | A | 9/1988 | Baker et al. | 346/1.1 |
| 4,775,594 | A | 10/1988 | Desjarlais | 428/421 |
| 4,780,356 | A | 10/1988 | Otouma et al. | 428/212 |
| 4,785,313 | A | 11/1988 | Higuma et al. | 346/135.1 |
| 4,879,166 | A | 11/1989 | Misuda et al. | 428/212 |
| 4,963,189 | A | 10/1990 | Hindagolla | 106/22 |
| 5,008,231 | A | 4/1991 | Yoshizawa et al. | 503/207 |
| 5,013,603 | A | 5/1991 | Ogawa et al. | 428/331 |
| 5,091,359 | A | 2/1992 | Ishida et al. | 503/209 |
| 5,104,730 | A | 4/1992 | Misuda et al. | 428/304.4 |
| 5,185,034 | A | 2/1993 | Webb et al. | 106/22 R |
| 5,194,347 | A | 3/1993 | Vermeulen et al. | 430/14 |
| 5,266,383 | A | 11/1993 | Sakaki et al. | 428/195 |
| 5,278,584 | A | 1/1994 | Keefe et al. | 346/140 R |
| 5,354,634 | A | 10/1994 | Misuda et al. | 430/18 |
| 5,397,619 | A | 3/1995 | Kuroyama et al. | 428/141 |
| 5,418,078 | A | 5/1995 | Desie et al. | 428/704 |
| 5,463,178 | A | 10/1995 | Suzuki et al. | 428/216 |
| 5,472,773 | A | 12/1995 | Misuda et al. | 428/195 |
| 5,478,631 | A | 12/1995 | Kawano et al. | 428/212 |
| 5,514,636 | A | 5/1996 | Takeuchi | 503/207 |
| 5,576,088 | A | 11/1996 | Ogawa et al. | 428/327 |
| 5,605,750 | A | 2/1997 | Romano et al. | 428/304.4 |

(List continued on next page.)

FOREIGN PATENT DOCUMENTS

| | | | |
|---|---|---|---|
| DE | 3828731 | A1 | 3/1989 |
| EP | 0474122 | A2 | 3/1992 |
| EP | 0803374 | A2 | 10/1997 |
| EP | 1033259 | A2 | 9/2000 |
| GB | 2321901 | A | 8/1998 |
| JP | 10-181189 | | 7/1998 |

*Primary Examiner*—B. Hamilton Hess

(57) ABSTRACT

Ink-receiving media print media products having multi-functional capabilities including (A) minimal drying time; (B) improved gloss-control which allows the production of high-gloss or semi-gloss products as desired; and (C) the ability to generate high-definition and light-fast images. A first embodiment (high-gloss) employs a substrate (e.g. polyethylene-coated paper) having a porous medial layer thereon containing a pigment (e.g. silica) and a binder (e.g. polyvinyl alcohol). A non-porous top layer is placed on the medial layer which optimally consists entirely of one or more binders (excluding pigments, etc.) A second embodiment (semi-gloss) employs a comparable substrate and medial layer with a top layer similar to that described above, although at least one pigment (e.g. silica) is employed therein at a level not exceeding about 10% by weight. Both products provide the foregoing benefits and others.

5 Claims, 2 Drawing Sheets

U.S. PATENT DOCUMENTS 5,609,964 A 3/1997 Ogawa et al. ..... 428/520
5,635,297 A 6/1997 Ogawa et al. ..... 428/342
5,637,196 A 6/1997 Ogawa et al. ..... 162/135
5,677,067 A 10/1997 Kojima et al. ..... 428/478.2
5,691,046 A 11/1997 Matsubara et al. ..... 428/310.5
5,723,211 A 3/1998 Romano et al. ..... 428/328
5,753,588 A 5/1998 Iida et al. ..... 503/217
5,755,929 A 5/1998 Kuroyama et al. ..... 162/137
5,759,673 A 6/1998 Ikezawa et al. ..... 428/198
5,798,173 A 8/1998 Momma et al. ..... 428/342
5,804,293 A 9/1998 Nehmsmann et al. .... 428/307.3
5,863,648 A 1/1999 Ohmura et al. ..... 428/331
5,882,388 A 3/1999 Adair et al. ..... 106/31.6
5,912,071 A 6/1999 Takeshita et al. ..... 428/304.4
5,916,673 A 6/1999 Fryberg et al. ..... 428/328
5,928,789 A 7/1999 Chen et al. ..... 428/413
5,962,124 A 10/1999 Yoshino et al. ..... 428/328
5,965,244 A 10/1999 Tang et al. ..... 428/195
5,965,252 A 10/1999 Santo et al. ..... 428/329
5,975,686 A 11/1999 Hauck et al. ..... 347/85
5,977,019 A 11/1999 Ozeki et al. ..... 503/204
5,985,076 A 11/1999 Misuda et al. ..... 156/230
5,989,701 A 11/1999 Goetzen et al. ..... 428/327
6,063,489 A 5/2000 Kobayashi et al. ..... 428/328
6,214,449 B1 * 4/2001 Otani et al. ..... 428/218

* cited by examiner

HIGH EFFICIENCY PRINT MEDIA PRODUCTS AND METHODS FOR PRODUCING THE SAME

BACKGROUND OF THE INVENTION

The present invention generally relates to print media products for receiving printed images thereon. More particularly, the invention described herein involves image-receiving sheet materials incorporating a specialized arrangement of layers and components which cooperate to produce a number of important benefits in a simultaneous fashion including but not limited to a high degree of lightfastness, gloss-control, rapid drying time, and others as discussed below.

Substantial developments have been made in the field of electronic printing technology. A wide variety of highly-efficient printing systems currently exist which are capable of dispensing ink in a rapid and accurate manner. Thermal inkjet systems are especially important in this regard. Printing units using thermal inkjet technology basically involve an apparatus which includes at least one ink reservoir chamber in fluid communication with a substrate (preferably made of silicon [Si] and/or other comparable materials) having a plurality of thin-film heating resistors thereon. The substrate and resistors are maintained within a structure that is conventionally characterized as a "printhead". Selective activation of the resistors causes thermal excitation of the ink materials stored inside the reservoir chamber and expulsion thereof from the printhead. Representative thermal inkjet systems are discussed in, for example, U.S. Pat. No. 4,771,295 to Baker et al. and U.S. Pat. No. 5,278,584 to Keefe et al. which are both incorporated herein by reference.

The ink delivery systems described above (and comparable printing units using thermal inkjet technology) typically include an ink containment unit (e.g. a housing, vessel, or tank) having a self-contained supply of ink therein in order to form an ink cartridge. In a standard ink cartridge, the ink containment unit is directly attached to the remaining components of the cartridge to produce an integral and unitary structure wherein the ink supply is considered to be "on-board" as shown in, for example, U.S. Pat. No. 4,771,295 to Baker et al. However, in other cases, the ink containment unit will be provided at a remote location within the printer, with the ink containment unit being operatively connected to and in fluid communication with the printhead using one or more ink transfer conduits. These particular systems are conventionally known as "off-axis" printing units. A representative, non-limiting off-axis ink delivery system is discussed in, for example, U.S. Pat. No. 5,975,686 to Hauck et al. which is also incorporated herein by reference. The present invention as described below (which involves a plurality of novel ink-receiving print media products) is applicable to both on-board and off-axis systems (as well as any other types which include at least one ink containment vessel that is either directly or remotely in fluid communication with a printhead containing one or more ink-ejecting resistors therein). Furthermore, while the print media materials outlined herein will be discussed with primary reference to thermal inkjet technology, it shall be understood that they may be employed in connection with other ink delivery systems and methods including but not limited to piezoelectric drop devices of the variety disclosed in U.S. Pat. No. 4,329,698 to Smith and dot matrix units of the type described in U.S. Pat. No. 4,749,291 to Kobayashi et al., as well as other comparable and diverse systems designed to deliver ink using one or more ink delivery components/assemblies. In this regard, the claimed print media products and methods shall not be considered "print method-specific".

In order to effectively generate printed images using the various ink transfer techniques and systems discussed herein (again, with primary but not exclusive reference to thermal inkjet technology), ink-receiving print media materials must be employed which are capable of efficiently accomplishing this goal. Ideally, to achieve maximum efficiency, print media materials should be able to provide numerous advantages and benefits including but not limited to (1) a high level of light-fastness, with the term "light-fastness" being generally defined herein to involve the capacity of a print media product to retain images thereon in a stable fashion without substantial fading, blurring, distortion, and the like over time in the presence of natural or made-made light; (2) rapid drying times in order to avoid smudging and image deterioration immediately after printing is completed due to contact with physical objects and the like; (3) the fast and complete absorption of ink materials in a manner which avoids image distortion caused by color bleed (e.g. the undesired migration of multi-colored ink components into each other) and related difficulties; (4) a highly water-fast character (with the term "water-fast" being generally defined to involve the ability of a print media product to produce a stable image with little or no fading, run-off, distortion, and the like when the image is placed in contact with moisture); (5) the generation of "crisp" images with a distinct and defined character; (6) low material costs which enable the print media products of interest to be employed for mass market home and business use; (7) excellent levels of image stability and retention over long time periods; (8) minimal complexity from a production and material-content standpoint which leads to reduced fabrication costs and greater product reliability; and (9) a high level of gloss-control which is achievable in a rapid and effective manner during production through only minor adjustments in the manufacturing process. The term "gloss-control" is generally defined herein to involve the ability, during fabrication, to generate a print media product having high-gloss levels for the generation of photographic quality images if desired, a semi-gloss character if needed, or other gloss parameters. In particular, the manufacturing process should be highly controllable in order to achieve a variety of different gloss characteristics without requiring major adjustments in processing steps and materials.

In the past, many different print media sheets using a wide variety of different ingredients, production techniques, layering arrangements, and the like have been fabricated for a multitude of specific purposes. For example, as generally discussed in the representative patent documents listed below, the following items have been investigated and/or employed in the production of print media products to achieve a broad spectrum of goals: modifications in the types of materials being used, the amounts of such materials, the relative particle sizes thereof, the particular layering arrangements being chosen, and the adjustment of various factors including pore size, pore volume, layer thickness, particle orientation, surface roughness, surface rigidity, air permeability, and other similar parameters. Representative patents (incorporated herein by reference) which discuss at least one or more of the above-listed factors (and others) are as follows: U.S. Pat. Nos. 4,391,850; 4,440,827; 4,446,174; 4,474,847; 4,567,096; 4,623,557; 4,642,247; 4,780,356; 4,785,313; 4,879,166; 5,008,231; 5,013,603; 5,091,359; 5,104,730; 5,194,347; 5,266,383; 5,354,634; 5,397,619;

5,463,178; 5,472,773; 5,514,636; 5,576,088; 5,605,750; 5,609,964; 5,635,297; 5,691,046; 5,723,211; 5,753,588; 5,755,929; 5,804,293; 5,863,648; 5,882,388; 5,912,071; 5,928,789; 5,962,124; 5,965,244; 5,977,019; 5,985,076; and 6,063,489.

Notwithstanding the various media products discussed in the above-listed patents and prior activities in this field, a need remains for print media materials (namely, ink-receiving sheets) which are able to capture and retain clear, distinct, and accurate images thereon that are likewise characterized by a number of specific benefits in combination. These benefits include but are not limited to items [1]–[9] recited above both on an individual and simultaneous basis in a substantially automatic manner (with the simultaneous achievement of such goals being of particular importance and novelty). The attainment of these objectives is especially important regarding the following specific items: gloss-control (with high-gloss levels being of primary interest in a preferred embodiment), excellent light-fastness, rapid drying time, and the generation of clear, durable, and distinct printed images. The present invention and its various embodiments perform all of the functions recited above in a highly effective and simultaneous manner while using a minimal number of material layers, chemical compositions, and production steps. In particular (as will become readily apparent from the discussion provided herein), the foregoing advantages and attributes are achieved through a highly unique and specialized layering arrangement and selection of materials. As a result, print media structures of minimal complexity are created that nonetheless exhibit a substantial number of beneficial characteristics and features in an unexpectedly efficient fashion. In this regard, the present invention represents a distinctive and important advance in the print media and image generation fields. Specific and detailed information concerning the novel print media materials of the invention and specialized fabrication methods associated therewith (which are equally unique) will be presented below in the following Summary of the Invention, Brief Description of the Drawings, and Detailed Description of Preferred Embodiments Sections.

SUMMARY OF THE INVENTION

It is an object of the present invention to provide highly efficient print media products for receiving inks, pigments, and other colorants thereon so that a printed image may be generated.

It is another object of the invention to provide highly efficient print media products which enable the generation of stable printed images thereon from a variety of different coloring agents in many divergent forms.

It is another object of the invention to provide highly efficient print media products which facilitate the generation of printed images that are light-fast and water-fast as defined above.

It is another object of the invention to provide highly efficient print media products wherein the printed images produced thereon may be generated using a wide variety of printing technologies including but not limited to those which employ thermal inkjet technology.

It is another object of the invention to provide highly efficient print media products which are able to retain printed images thereon that exhibit an excellent degree of stability over prolonged time periods and under conditions of varying temperature, humidity, and the like.

It is another object of the invention to provide highly efficient print media products wherein the printed images produced thereon are characterized by rapid drying times.

It is another object of the invention to provide highly efficient print media products wherein the overall level of gloss is readily controlled without major adjustments to the production process, with such process readily allowing the fabrication of high-gloss or semi-gloss products in an effective and economical manner.

It is another object of the invention to provide highly efficient print media products which are able to effectively accomplish all of the above-listed goals and others (including the generation of images that are substantially water-fast and highly-defined) in a simultaneous fashion, with this aspect of the invention being accomplished in accordance with the unique layering arrangements and chosen construction materials discussed herein.

It is a further object of the invention to provide highly efficient print media products which are able to effectively accomplish all of the above-listed goals using a minimal number of material layers and construction materials.

It is an even further object of the invention to provide highly efficient print media products which employ layering arrangements and construction materials that are readily suited to large scale mass-production fabrication processes in an economical fashion.

It is an even further object of the invention to provide highly efficient print media products that are readily used in a wide variety of different printing systems with differing inks for many diverse purposes.

It is a still further object of the invention to provide highly efficient, rapid, and economical manufacturing methods which may be employed to produce the print media products of the present invention as discussed herein.

Novel and effective print media products (also characterized herein as "print media sheets", "ink-receiving sheets", and the like) are described below which offer numerous advantages and benefits over prior structures. These benefits and advantages include, without limitation, the simultaneous achievement of items [1]–[9] recited above with particular reference to (A) light-fastness as previously defined; (C) the generation of highly defined and distinct images; and (D) a high degree of gloss-control as also defined above. In this regard, the claimed invention represents a significant advance in the print media technology and image generation fields.

As a preliminary point of information, the present invention shall not be restricted to any particular types, sizes, material-selections, arrangements of print media materials, components, chemical compositions, layering sequences, numbers of layers, layer orientations, thickness values, porosity parameters, and other related factors unless otherwise stated herein. Likewise, the numerical values listed in this section and the other sections provided below constitute preferred embodiments designed to provide optimum results and shall not limit the invention in any respect. In particular, it shall be understood that the specific embodiments discussed herein and illustrated in FIGS. 1–3 (along with the particular construction materials associated therewith) constitute special versions of the invention which, while non-limiting in nature, provide excellent results and are highly distinctive. All recitations of chemical formulae and structures set forth in the following discussion are intended to generally indicate the types of materials which may be used in this invention. The listing of specific chemical compositions which fall within the general formulae and classifications presented below are offered for example purposes only and shall be considered non-limiting.

The claimed invention and its novel developments are applicable to a wide variety of printing systems with particular reference to those that employ thermal inkjet technology as previously discussed. Likewise, a number of different ink materials can be used in connection with the invention without limitation, with the term "ink materials" being defined to encompass compositions incorporating dyes, pigments, and other colorants without restriction. In this regard, the claimed print media products shall not be considered "ink-specific" or "printing method-specific" in any fashion.

It should also be understood that the present invention shall not be limited to any particular construction techniques (including any given material deposition procedures, layering arrangements, and the like) unless otherwise stated below. For example, the terms "forming", "applying", "delivering", "placing", "positioning", "operatively attaching", "operatively connecting", "converting", "providing", and the like as used throughout this discussion and as claimed shall broadly encompass any appropriate manufacturing procedures including, without limitation, roll-coating, spray-coating, immersion-coating, cast-coating, and other related production methods. In this regard, the invention shall not be considered "production method-specific" unless otherwise stated herein, with the recitation of any particular fabrication techniques, layer deposition methods, number of layers being applied in a given step, and the like being set forth for example purposes only.

Likewise, it shall be understood that the terms "operative connection", "operative attachment", "in operative connection", "in operative attachment", "positioned on", "located on", "positioned above", "positioned over and above", "located over and above", and the like as used and claimed herein shall be broadly construed to encompass a variety of divergent layering arrangements and assembly techniques. These arrangements and techniques include but are not limited to (1) the direct attachment of one material layer to another material layer with no intervening material layers therebetween; and (2) the attachment of one material layer to another material layer with one or more material layers therebetween provided that the one layer being "attached to", "connected to", or "positioned over and above", the other layer is somehow "supported" by the other layer (notwithstanding the presence of one or more additional material layers therebetween). Use of the phrase "direct attachment", "directly attached on", "directly attached to", "directly positioned on", "directly located on", and the like shall signify a situation wherein a given material layer is secured to another material layer without any intervening material layers therebetween. Any statement used herein which indicates that one layer of material is "above", "over", or "on top of" another layer shall involve a situation wherein the particular layer that is "above", "over", or "on top of" of the other layer in question shall be the outermost of the two layers relative to incoming ink materials being delivered by the printing system of interest. The opposite situation will be applicable regarding use of the terms "below", "under", "beneath", "on the bottom of", and the like. The characterizations recited above shall be effective regardless of the orientation of the print media materials under consideration.

Furthermore, any and all recitations of structures, layers, materials, and components in the singular throughout the claims, Summary of the Invention, and Detailed Description of Preferred Embodiments sections shall be construed to encompass a plurality of such items unless otherwise specifically noted herein.

As previously indicated, highly effective and versatile print media materials designed to receive ink materials thereon for the generation of clear, stable, and distinct printed images are provided. Many different ink delivery systems can be employed to generate the printed images of interest on the claimed media products without limitation although the use of devices that incorporate thermal inkjet technology are again preferred. Regardless of which ink delivery system is chosen, the present invention is capable of offering the considerable benefits listed above which include more efficient, rapid, and reliable image generation.

The following discussion shall constitute a brief and general overview of the invention which shall not limit the invention in any respect. More specific details concerning particular embodiments and other important features of the invention will again be recited in the Detailed Description of Preferred Embodiments section set forth below. All scientific terms used throughout this discussion shall be construed in accordance with the traditional meanings attributed thereto by individuals skilled in the art to which this invention pertains unless a special definition is provided herein.

As previously stated, the claimed invention involves one or more novel print media products (discussed in connection with a plurality of preferred embodiments) which are characterized by improved functional abilities, namely, more efficient image generation (e.g. excellent gloss-control/uniformity, rapid drying, image clarity, light-fastness, water-fastness, and the like which are all achieved in a simultaneous and automatic fashion). The components and novel features associated with the claimed print media products will now be briefly summarized.

In order to produce a preferred print media product in accordance with the invention, a support structure or "substrate" (with both terms being considered equivalent from a structural and functional standpoint) is initially provided on which the other layers associated with the print media product reside. Many different construction materials can be employed in connection with the substrate including those which are made from paper, plastics, or metals without limitation although paper (any commercially-available type) is preferred. The chosen substrate may be coated or uncoated on either or both sides thereof. In a preferred embodiment designed to provide optimum results, the substrate will include an upper surface (also characterized herein as a "first side") and a lower surface (also characterized herein as a "second side"), with at least one of such surfaces/sides (preferably the upper surface or both surfaces) being covered with a substantially non-porous, non-absorbent, and ink-impermeable composition in the form of a coating layer. A representative and exemplary coating composition associated with this embodiment involves polyethylene when a paper substrate is employed. However, other coating/substrate combinations can be employed without limitation, or the use of substrate coatings can be eliminated entirely if desired as determined by routine preliminary pilot testing.

Positioned (e.g. provided) over and above the substrate (and fixedly secured thereto with "direct attachment" of such layers as defined above being preferred but not necessarily required) is a "medial layer" of material. From a functional standpoint, the medial layer is designed to provide a high degree of "capacity" (e.g. ink-retention capability) in connection with the media product, to facilitate rapid drying of the printed, image-containing media product, to create a media product with a smooth/even surface, and to otherwise ensure that the desired gloss characteristics are maintained in the finished product. To accomplish these goals, the medial layer is optimally porous and generally non-swellable in the presence of liquids, with the term "porous" being basically defined in a conventional fashion to involve a structure or material having a plurality of pores therein through which fluids, etc. may pass. The transfer of fluids including ink and the like into and through the medial layer occurs via physical phenomena normally associated with porous materials including capillary action and the like. It should be noted that, if a substrate is employed which is coated (e.g. polyethylene-coated paper in a preferred embodiment), the medial layer and remaining layer(s) discussed below are optimally placed on the side or sides that are covered with the chosen coating formulation.

The primary ingredients used to fabricate the medial layer include at least one pigment and at least one binder although it shall be understood that various optional ingredients including fillers, surfactants, preservatives, and the like may also be combined therewith. The need for such other ingredients shall be determined by routine preliminary pilot testing. Nonetheless, the use of at least one pigment and binder without any other ingredients will function effectively in the present embodiment, although the addition of other ingredients as noted above is possible. A preferred pigment consists of silica ($SiO_2$). Likewise, a representative and non-limiting silica material which may be employed in connection with the medial layer involves silica gel (discussed in greater detail below) having an exemplary and mean silica particle size value (e.g. diameter) of about 0.3–0.4 gm in water and mean porosity value of about 0.8–0.9 cc/g. However, other types of silica with differing particle size, porosity, and other parameters can be employed if needed and desired.

Combined with the above-mentioned pigment (preferably silica) is at least one binder (also referred to herein as a "primary binder") which is optimally of a water-soluble or water-dispersible organic polymer type. Regarding the binders used in the current embodiment and all other embodiments of the present invention, the term "primary binders" (or "primary binder") shall be used in connection with the binder materials employed in the medial layer while "secondary binders" (or "secondary binder") shall involve the binder compounds incorporated within the top layer (discussed below). A number of different primary binder materials alone or in combination can be employed within the medial layer. However, highly effective results are achieved through the use of polyvinyl alcohol as the sole primary binder in the medial layer. While the claimed invention shall not be restricted to any particular numerical quantities in connection with the chemical ingredients in the medial and other layers associated therewith, a preferred embodiment designed to provide best results will involve the use of a medial layer having the following pigment and primary binder quantities: about 67–87% by weight pigment (e.g. silica) with about 77% by weight being preferred, and about 13–33% by weight primary binder (e.g. polyvinyl alcohol) with about 23% by weight being preferred. It should be noted that, unless otherwise stated herein, all percentage figures describing the material content of the various layers discussed in the claims, Summary of the Invention, and Detailed Description of Preferred Embodiments sections shall involve "dry weight", namely, the weight of the chosen component in the dried material layer of interest. Likewise, as previously stated, the claimed invention shall not be restricted to any given material quantities in connection with a given layer, with such quantities being subject to variation as needed and desired in accordance with routine preliminary testing. The preferred and non-limiting percentage figures recited herein for all of the ingredients employed in the various layers of this invention shall optimally represent values which reflect the total amount of the ingredient under consideration whether a single composition is employed or multiple compositions in combination are used. For example, the representative 23% by weight primary binder value recited above shall involve a situation where 23% by weight of a single binder may be employed or multiple binders in combination can be used which collectively constitute (as a total) 23% by weight of the dried media layer.

Next, positioned (e.g. provided) over and above the medial layer (and fixedly secured thereto with "direct attachment" of such layers as defined above being preferred but not necessarily required) is a "top layer" of material. From a functional standpoint, the top layer is designed to provide a high-gloss character to the print media product and to likewise ensure the generation of clear and distinct images with high quality levels, rapid drying times, and a permanent/stable character. In this regard, the top layer is optimally high-gloss, non-porous, and generally swellable in the presence of liquids, with the term "non-porous" being basically defined in a conventional fashion to involve a structure or material lacking a plurality of pores therein through which fluids, etc. may pass. The transfer of fluids including liquid ink and the like into and through the top layer occurs via physical phenomena normally associated with non-porous materials including non-capillary absorption and the like. While, in a preferred embodiment, the top layer shall be construed to involve the layer of material that is uppermost and the first layer to receive ink materials from the printer unit under consideration, it is contemplated in other embodiments that one or more additional layers/coatings may also be placed over and above the top layer without limitation. However, as outlined further below, the two-layer design discussed herein which employs the medial layer and top layer thereover (with the top layer being the first layer to receive ink materials) is particularly unique in terms of simplicity, functionality, and versatility.

The top layer in the present embodiment is particularly unusual in that it preferably involves a structure consisting essentially of one or more (e.g. at least one) binder materials (also characterized herein as "secondary binders"). In accordance with the phrase "consisting essentially of" in the presently-described embodiment, the top layer will not contain therein any pigments or fillers (of a particulate or non-particulate nature) in more than negligible/trace quantities (for example, those quantities that would incidentally be present as a result of the manufacturing processes being employed). In other words, the top layer in the current embodiment will not include any pigments or fillers therein aside from minute, trace amounts that would be considered inconsequential. Likewise, as a general proposition, the top layer in this embodiment will not contain therein any composition(s) that would materially affect or alter the high-gloss character and/or non-porous nature of the top layer (for instance, to make it more porous or porous in general). In the present embodiment (which, while preferred and novel, shall not be considered the only embodiment in this case), it is therefore desired that the top layer be fabricated so that it is "binder-only" from a material-content standpoint (e.g. optimally 100% by weight of one or more "secondary binder" materials). However, in accordance with the definitions listed above, it is possible that additional materials (namely, preservatives, surfactants, and others) may be added to the top layer as needed and desired provided that they again fit within the foregoing definitions.

In order to facilitate the goals of the top layer as outlined above in an especially effective manner, a plurality (e.g. two or more) of secondary binders are incorporated within the top layer, with each of the chosen secondary binders preferably being different and providing the completed top layer with multiple attributes. A number of different secondary binders alone or in combination may be used without limitation as discussed further below in the Detailed Description of Preferred Embodiments section. However, it has been discovered that unexpectedly effective results can be obtained through the use of three very special and distinctive secondary binder classes and materials in combination. Specifically, such classes (and a preferred composition within each class) are as follows: (1) Secondary Binder No. 1: a polyvinyl alcohol (particularly, acetoacetylated polyvinyl alcohol); (2) Secondary Binder No. 2: a polyurethane (particularly, at least one modified polyurethane resin dispersion); and (3) Secondary Binder No. 3: a polyamide resin (particularly, at least one epichlorohydrin-containing polyamide). Further information regarding these specific compounds, classes of materials, and other representative secondary binders will again be discussed below in the Detailed Description of Preferred Embodiments section. It should also be understood that, in a still further novel embodiment, the three specific secondary binders recited above, namely, a polyvinyl alcohol (particularly, acetoacetylated polyvinyl alcohol), a polyurethane (particularly, a modified polyurethane resin dispersion), and a polyamide resin (particularly, an epichlorohydrin-containing polyamide) could be employed in combination within the top layer along with other compositions such as pigments, fillers, and the like without restriction. However, the embodiment recited above which consists essentially of binders is again preferred.

All of the binders selected for use in the top layer preferably involve water-soluble or water-dispersible organic polymers. While the top layer shall not be restricted in connection with the types of secondary binders that are employed, the number of secondary binders being used, and/or the relative quantities of such binders, representative amounts of Secondary Binder Nos. 1–3 are as follows: about 74–94% by weight Secondary Binder No. 1 (e.g. a polyvinyl alcohol, optimally, acetoacetylated polyvinyl alcohol) with about 84% by weight being preferred, about 5–15% by weight Secondary Binder No. 2 (e.g. a polyurethane, optimally, a modified polyurethane resin dispersion) with about 10% by weight being preferred, and about 1–12% by weight Secondary Binder No. 3 (e.g. a polyamide resin, namely, an epichlorohydrin-containing polyamide) with about 6% by weight being preferred. It should again be noted and understood that, unless otherwise stated-herein, all percentage figures describing the material content of the various layers discussed in the claims, Summary of the Invention, and Detailed Description of Preferred Embodiments sections shall involve "dry weight", namely, the weight of the chosen component in the dried material layer of interest. Likewise, the present invention shall again not be restricted to any given material quantities in connection with a particular layer or layers in the claimed print media products, with such quantities being subject to variation as needed and desired in accordance with routine preliminary testing. The preferred and non-limiting percentage figures recited herein for all of the ingredients employed in the various layers of this invention shall optimally represent values which reflect the total amount of the ingredient under consideration whether a single composition is employed or multiple compositions in combination are used.

The above-listed print media product represents a preferred embodiment of the current invention. As a point of general information, the-layers of materials associated with all of the embodiments expressed herein may be placed on one side (preferred) of the coated or uncoated substrate or on both sides without limitation. If a coated substrate is employed, it is particularly desirable to place the material layers on the coated side(s). Likewise, a number of different manufacturing techniques may be implemented in connection with this embodiment (and the other versions of the present invention) without restriction as outlined further below. However, from a general standpoint, the claimed method of interest regarding the above-listed embodiment will encompass the following basic steps (with the previously-described information involving construction materials and the like being incorporated by reference in the current discussion): (1) providing a substrate; (2) applying a medial layer in position over and above the substrate, with the medial layer being comprised of silica and at least one primary binder composition; and (3) placing a top layer over and above the medial layer, with the top layer consisting essentially of at least one secondary binder composition. Numerous variations are again possible in connection with the foregoing method which shall be encompassed within the claims provided below. One optional step which may be employed between steps (2) and (3) involves delivering a citric acid solution (e.g. about 0.7% by weight citric acid in a preferred and non-limiting embodiment) onto the surface of the medial layer prior to placement of the top layer in position thereover. It has been discovered that the use of this particular solution can assist in avoiding undesired bubble formation in the top layer, thereby ensuring that the top layer has a uniform consistency-which facilitates proper image formation thereon.

At least one or more additional embodiments of the present invention likewise exist with primary reference to a particular alternative print media sheet which will now be discussed. All of the information, materials, parameters, functional attributes, ingredient types, and other data concerning (1) the substrate; and (2) the medial layer as discussed above in connection with the first embodiment are applicable to the currently-described alternative embodiment unless otherwise stated herein and are therefore incorporated by reference in the present discussion. The main distinction between the first and second embodiments involves the material-content of the top layer which will now be described in detail. The top layers in both embodiments may, in fact, be the same from a secondary binder-standpoint, with all of the above-listed data regarding representative secondary binders, secondary binder types, secondary binder classes, etc. being applicable to the current embodiment and also incorporated herein by reference. However, in the embodiment presently being summarized, an additional ingredient is employed in combination with the secondary binder(s), namely, a small quantity of at least one (e.g. one or more) pigment. While the present invention shall not be restricted to any given pigment material or materials for this purpose, the use of silica is preferred (e.g. of the "precipitated" variety in an exemplary and non-limiting embodiment). This material is employed to create a "satin"-type, "semi-gloss" top layer compared with the high-gloss character of the previous embodiment. To accomplish this goal, it is a novel feature of the second embodiment to employ a total pigment (e.g. silica) amount not more than about 10% by weight, namely, the dry weight of the dried top layer. This particular quantity value not only preserves and maintains the benefits provided by the secondary binder (s) from a non-porosity standpoint, but at the same time adds a semi-gloss, satin-type character to the top surface of the print media product. In particular, by carefully controlling the amount of pigment (e.g. silica) to not exceed about 10% by weight, the top layer can maintain its non-porous character which is desirable for the reasons given above while also exhibiting a semi-gloss, satin-type finish which is a distinctive combination of features. When employed in connection with a specialized medial layer containing a pigment (namely, silica) and a binder (preferably polyvinyl alcohol), the above-listed top layer creates a unique media sheet having multi-functional capabilities. It is especially important that these multiple capabilities are provided using only two material layers on the substrate. Accordingly, the second embodiment of the claimed invention likewise represents a significant advance in the art of print media technology from a structural and functional standpoint.

To quantitatively account for the pigment in the top layer of the current embodiment, it is preferred that the amount of secondary binder (or binders) be reduced. The claimed invention shall not be restricted to any particular secondary binder or binders that are decreased in quantity which may vary depending on the types of binders under consideration and whether multiple binders are employed. In a preferred version of the invention wherein the above-listed secondary binder compositions are used (e.g. Secondary Binder Nos. [1]–[3]), a representative and non-limiting embodiment will involve a reduction in the amount of the secondary binder which, in the absence of any pigments, would be present in the greatest quantity. In the current exemplary embodiment, this would involve Secondary Binder No. 1 as recited above (e.g. a polyvinyl alcohol, namely, acetoacetylated polyvinyl alcohol), with the reduction in this material equaling the amount of added pigment (e.g. silica). Thus, in the current non-limiting example which again represents an optimized version of the claimed invention, the following quantities would be employed: about 68–88% by weight Secondary Binder No. 1 (e.g. a polyvinyl alcohol, optimally, acetoacetylated polyvinyl alcohol) with about 78% by weight being preferred, about 5–15% by weight Secondary Binder No. 2 (e.g. a polyurethane, optimally, a modified polyurethane resin dispersion) with about 10% by weight being preferred, about 1–12% by weight Secondary Binder No. 3 (e.g. a polyamide resin, namely, an epichlorohydrin-containing polyamide) with about 6% by weight being preferred, and about 2–10% by weight pigment (e.g. silica) with about 6% by weight being preferred. Again, all of the percentage figures recited above represent dry weight (namely, the weight of the ingredient under consideration on a percentage basis as part of the overall dried top layer).

The numerical values listed herein shall not limit the invention in any respect and instead constitute preferred and optimized examples which are subject to modification as needed and desired. Regardless of the amounts and types of secondary binders that are employed within the top layer of the current embodiment, the addition of a pigment (namely, silica) in an amount not exceeding about 10% by weight will again serve to preserve the non-porous nature of the top layer which is desirable as previously noted, while likewise imparting a semi-gloss, satin-type finish to the completed print media product. The simultaneous provision of both features represents an important and unique concept which again constitutes a significant development in print media technology. As a further note concerning this alternative embodiment, additional materials (surfactants, preservatives, etc.) may likewise be employed within both the medial and top layers as needed and desired although, with reference to the top layer, it is preferred that no additional particulate or other compositions be employed therein including fillers, etc. (aside from the not more than 10% by weight pigment quantity and at least one secondary binder). Alternatively, if various other ingredients are added, it is preferred that they be of a type which would not materially affect or alter the semi-gloss character and/or non-porous nature of the top layer (for instance, to make it more porous or porous in general). In this regard, it is further preferred in a non-limiting fashion that the top layer in the current embodiment consist entirely or essentially of at least one secondary binder and not more than about 10% by weight pigment (e.g. silica).

A number of different manufacturing techniques may be employed in connection with the current alternative embodiment without restriction as outlined further below. However, from a general standpoint, the claimed method of interest regarding this embodiment will generally encompass the following steps (with the previously-described information involving construction materials and the like being incorporated by reference in the current discussion): (1) providing a substrate; (2) applying a medial layer in position over and above the substrate, with the medial layer being comprised of silica and at least one primary binder composition; and (3) placing a top layer over and above the medial layer, with the top layer being comprised of at least one secondary binder composition and silica, with the silica being present in an amount not exceeding about 10% by weight. Numerous variations are again possible in connection with the foregoing method which shall be encompassed within the claims provided below. One optional step which may, be employed between steps (2) and (3) involves delivering a citric acid solution (e.g. about 0.7% by weight citric acid in a preferred and non-limiting embodiment) onto the surface of the medial layer prior to placement of the top layer in position thereover. It has been discovered that the use of this particular solution can assist in avoiding undesired bubble formation in the top layer, thereby ensuring that the top layer has a uniform consistency which facilitates proper image formation thereon.

The completed print media products described herein are designed to receive and retain a printed image thereon in a highly effective manner. The novel features discussed above individually and collectively constitute a significant advance in the art of image generation and print media technology. In particular, the unique structures, components, and methods of the invention offer many important benefits compared with prior systems and products including but not limited to: (1) a high level of light-fastness; (2) rapid drying times; (3) the fast and complete absorption of ink materials in a manner which avoids image distortion caused by color bleed and related difficulties; (4) a highly water-fast character; (5) the generation of "crisp" images with a distinct and defined character; (6) low material costs which enable the print media products of interest to be employed for mass market home and business use; (7) excellent levels of image stability and retention over long time periods; (8) minimal complexity from a production and material-content standpoint which leads to reduced fabrication costs and greater product reliability; and (9) a high level of gloss-control which is achievable in a rapid and effective manner during production through only minor adjustments in the manufacturing process. These and other benefits, objects, features, and advantages of the invention will become readily apparent from the following Brief Description of the Drawings and Detailed Description of Preferred Embodiments.

BRIEF DESCRIPTION OF THE DRAWINGS

The drawing figures provided herein are schematic, representative, and not necessarily drawn to scale. They shall not limit the scope of the invention in any respect. Reference numbers which are carried over from one figure to another shall constitute common subject matter in the figures under consideration. Likewise, the cross-hatching shown in the drawing figures is provided for example purposes only and shall not restrict the invention to any particular construction materials. In addition, the illustration of any given number of elements, components, layers, and other structural features shall be considered representative only and shall not limit the invention in any respect unless otherwise expressly stated herein.

DETAILED DESCRIPTION OF PREFERRED EMBODIMENTS

Figure 1:
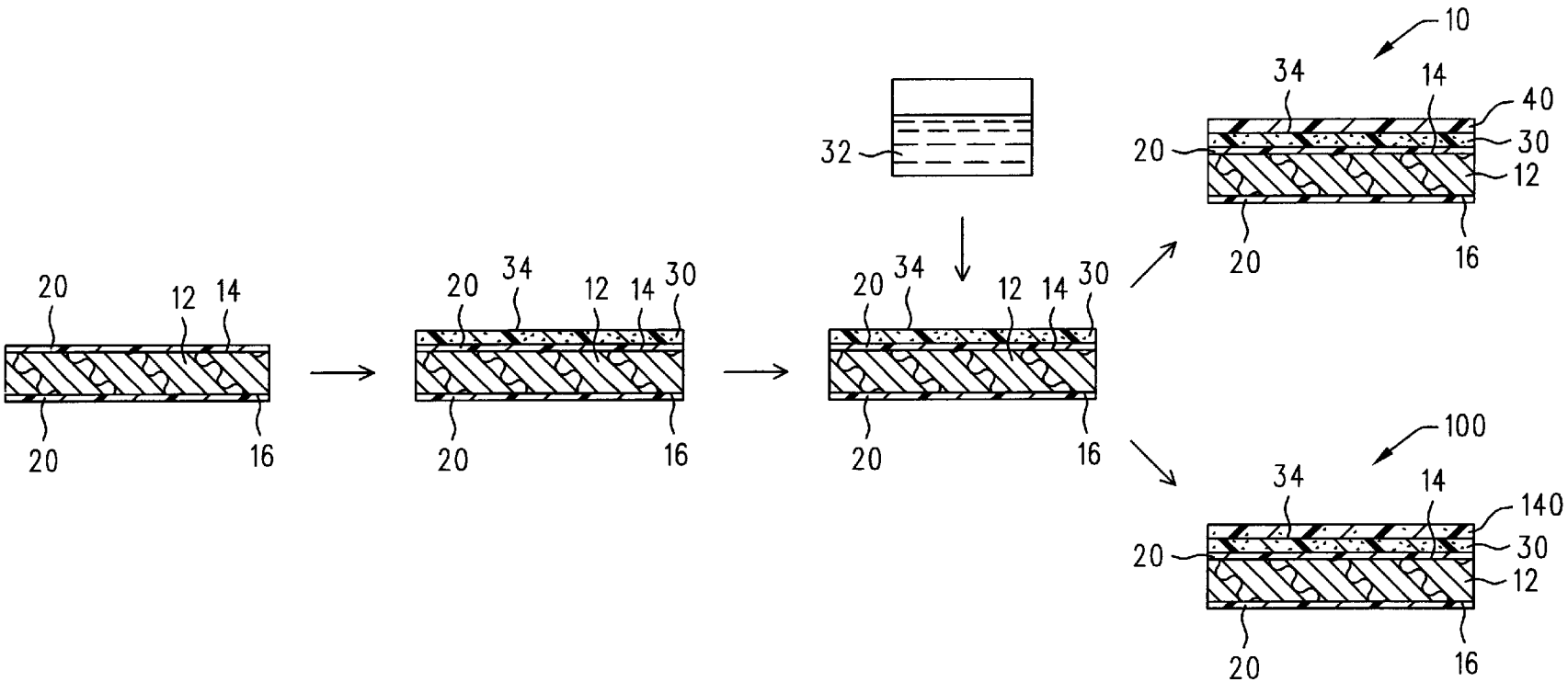
FIG. 1 is a schematically-illustrated, sequential view of the process steps, materials, and techniques in a preferred embodiment that are employed to produce the novel print media products of the present invention.

In accordance with the present invention, high-efficiency print media products (also characterized herein as "ink-receiving sheets") are provided which have multi-functional capabilities as noted above. In particular, the claimed media products offer multiple benefits in combination including but not limited to (A) the ability to generate light-fast images as previously defined; (B) the production of images that have a high degree of definition, clarity, and resolution; (C) rapid drying; and (D) an excellent level of gloss-control, namely, the ability during fabrication to generate a print media product having high-gloss levels for the generation of photographic quality images if desired, a semi-gloss character if needed, or other gloss parameters. In particular, the manufacturing processes described herein are highly controllable in order to achieve a variety of different gloss characteristics without requiring major adjustments in processing steps, materials, and the like. In this regard, the various embodiments of the claimed invention collectively constitute an advance in the print media and image generation fields.

Likewise, as previously stated, the print media products described herein are prospectively applicable to many different ink delivery systems and ink materials containing various dyes, pigments, and colorants. Of primary interest are ink delivery systems that employ thermal inkjet technology. Printing units using thermal inkjet technology again basically involve an apparatus which includes at least one ink reservoir chamber in fluid communication with a substrate (preferably made of silicon [Si] and/or other comparable materials) having a plurality of thin-film heating resistors thereon. The substrate and resistors are maintained within a structure that is conventionally characterized as a "printhead". Selective activation of the resistors causes thermal excitation of the ink materials stored inside the reservoir chamber and expulsion thereof from the printhead. Representative thermal inkjet systems are discussed in, for example, U.S. Pat. No. 4,771,295 to Baker et al. and U.S. Pat. No. 5,278,584 to Keefe et al. which are both incorporated herein by reference.

The ink delivery systems described above (and comparable printing units using thermal inkjet technology) typically include an ink containment unit (e.g. a housing, vessel, or tank) having a self-contained supply of ink therein in order to form an ink cartridge. In a standard ink cartridge, the ink containment unit is directly attached to the remaining components of the cartridge to produce an integral and unitary structure wherein the ink supply is considered to be "on-board" as shown in, for example, U.S. Pat. No. 4,771,295 to Baker et al. However, in other cases, the ink containment unit will be provided at a remote location within the printer, with the ink containment unit being operatively connected to and in fluid communication with the printhead using one or more ink transfer.conduits. These particular systems are conventionally known as "off-axis" printing units. A representative, non-limiting off-axis ink delivery system is again discussed in, for example, U.S. Pat. No. 5,975,686 to Hauck et al. which is also incorporated herein by reference. The present invention as described herein is applicable to both on-board and off-axis systems (as well as any other types which include at least one ink containment vessel that is either directly or remotely in fluid communication with a printhead containing at least one ink-ejecting resistor therein). Furthermore, while the print media products described in this section will be discussed with primary reference to thermal inkjet technology, it shall be understood that they may be employed in connection with other ink delivery systems and methods including but not limited to piezoelectric drop devices of the variety disclosed in U.S. Pat. No. 4,329,698 to Smith and dot matrix units of the type described in U.S. Pat. No. 4,749,291 to Kobayashi et al., as well as other comparable and diverse systems designed to deliver ink using one or more ink delivery components/assemblies. In this regard, the claimed print media products and methods shall not be considered "print method-specific". As an additional point of information, exemplary printer units which are suitable for use with the print media products of the present invention include but are not limited to those manufactured and sold by the Hewlett-Packard Company of Palo Alto, Calif. (USA) under the following product designations: 400C, 500C, 540C, 660C, 693C, 820C, 850C, 870C, 1200C, and 1600C, as well systems sold by the Hewlett-Packard Company under the "DESIGNJET®" trademark (5000 series), and others.

Furthermore, the claimed invention (namely, the novel print media products and production methods associated therewith) are not "ink-specific" and may be used in connection with a wide variety of inks, dyes, pigments, toner compositions, sublimation dyes, colorants, and the like without restriction. For example, representative ink compositions that can be employed in connection with the print media materials of this invention include but are not limited to those discussed in U.S. Pat. Nos. 4,963,189 and 5,185,034 (incorporated herein by reference) which represent only a small fraction of the ink compositions and colorant formulations that can be used with the present invention.

At this point, a detailed discussion of the claimed print media products will now be presented with the understanding that the data set forth below shall be considered representative in nature, with the current invention being defined by the claims presented herein. It shall also be understood that the recitation of specific materials and embodiments that are identified as "preferred" constitute novel developments that provide optimum and unexpectedly effective results. Furthermore, all of the definitions and terminology recited above in the Summary of the Invention section are applicable to and incorporated by reference in the current Detailed Description of Preferred Embodiments section.

Figure 2:
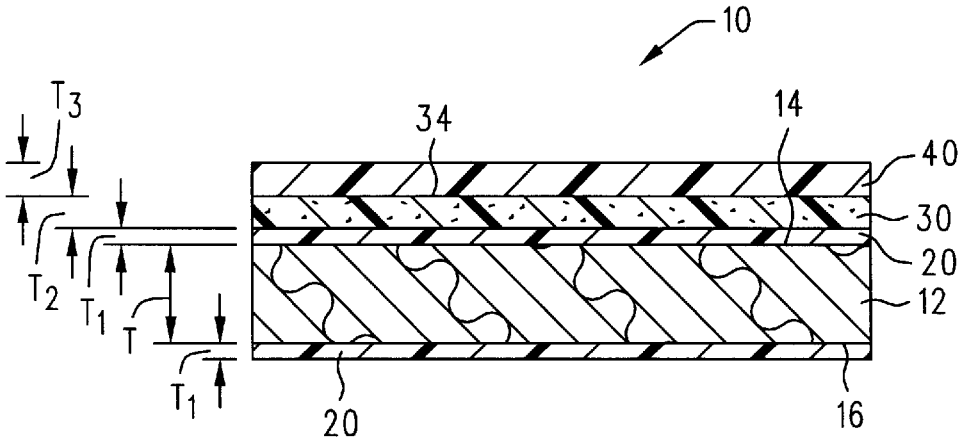
FIG. 2 is a schematically-illustrated and enlarged partial cross-sectional view of a completed print media product produced in accordance with a novel and preferred embodiment of the invention illustrating the material layers and thicknesses associated therewith.

In accordance with FIGS. 1 and 2, a preferred print media product in completed form for use as an image-receiving sheet is schematically illustrated at reference number 10. The methods, materials, process steps, and other data associated with print media product 10 will now be discussed. The print media product 10 is designed to have a high-gloss character which is accomplished using the particular construction materials identified below. For general information purposes, the term "gloss" is basically defined to involve the relative proportion of light that is specularly reflected from a given product, surface, or region relative to the total amount of light that is reflected. High-gloss print media products are particularly desirable in the production of photographic-quality images for a wide variety of home and commercial uses. As illustrated in FIGS. 1–2, a support structure or "substrate" 12 (with both terms being considered equivalent from a structural and functional standpoint) is initially provided on which the other layers and materials associated with the print media product 10 reside. The substrate 12 is optimally fabricated in the form of a flexible sheet having an upper surface 14 (also characterized herein as a "first side") and a lower surface 16 (also characterized herein as a "second side"), with both of the surfaces/sides 14, 16 being substantially planar and having a uniform surface texture in the representative embodiment of FIGS. 1–2. In a preferred version of the print media product 10 (which optimally involves the use of paper as the substrate 12), the substrate 12 will have an exemplary and non-limiting uniform thickness "T" (FIG. 2) along its entire length of about 0.025–0.25 mm, with this range also being applicable to all of the other substrate materials discussed herein. Other construction compositions that can be employed in connection with the substrate 12 aside from paper include but are not limited to metals (e.g. in foil form made from, for example, aluminum [Al], silver [Ag], tin [Sn], copper [Cu], mixtures thereof, and others as determined by the intended use of the completed print media product 10). Likewise, various organic polymer compositions can be employed in connection with the substrate 12 including but not limited to those fabricated from polyethylene, polystyrene, polyethylene terephthalate, polycarbonate resins, polytetrafluoroethylene (also known as "Teflon@"), polyimide, and mixtures thereof without limitation.

However, as previously stated, commercially-available paper is preferred in connection with the substrate 12, with the present invention not being limited to any particular type of paper. In a preferred and non-restrictive embodiment designed to offer optimum results (including a high degree of strength, flexibility, and durability), paper materials can be employed wherein at least one of the upper and lower surfaces (e.g. first and second sides) 14, 16 thereof (preferably the upper surface 14 which faces the various layers in the print media product 10 or both surfaces 14, 16) are coated with a substantially non-porous, non-absorbent, and ink-impermeable composition. In the representative embodiment illustrated schematically in FIGS. 1–2 a coating layer 20 is provided on the upper and lower surfaces 14, 16 of the substrate 12 (e.g. made of paper). The coating layer 20 optimally has a uniform thickness "$T_1$" (FIG. 2) of about 1–40 $\mu$m, with this range being subject to change as needed and desired. Preferably, the coating layer 20 is produced from polyethylene although other compositions can be employed for this purpose without restriction including but not limited to various organic polymers such as polystyrene, polyethylene terephthalate, polycarbonate resins, polytetrafluoroethylene (Teflon®), polyimide, and mixtures thereof. Again, while optional, the use of coating layer 20 can impart added strength and image clarity to the final print media product 10 although the coating layer 20 can be eliminated entirely if desired as again determined by routine preliminary pilot testing.

For the purposes of this invention, if a coated substrate 12 is employed as discussed above, the coating layer 20 shall be construed and defined as part of the substrate 12, with the representative thickness value "T" associated with the substrate 12 being suitably adjusted in this regard. Such a characterization is appropriate since coated paper materials including those discussed herein are traditionally available in pre-manufactured form from various paper suppliers and producers. For example purposes, a representative paper substrate 12 covered on both surfaces/sides 14, 16 with a coating layer 20 of polyethylene is commercially available in completed form from Felix Schoeller Technical Papers, Inc. of Pulaski, N.Y. (USA) [product designations 108395, 108396, and 108397, for example].

With continued reference to FIGS. 1–2, a medial layer 30 of material is applied to the coating layer 20 on the upper surface 14 of the substrate 12 so that the medial layer 30 is positioned over and above the substrate 12. The medial layer 30 is designed and configured for internal disposition within the interior regions of the completed print media product 10 as illustrated. The medial layer 30 is optimally configured for direct attachment to the coating layer 20/upper surface 14 of the substrate 12. As previously noted, the term "direct attachment" is defined to involve affixation of the medial layer 30 to the coating layer 20/upper surface 14 of the substrate 12 without any intervening material layers therebetween in order to minimize the number of material layers employed in the final print media product 10. However, it shall be understood that one or more intervening material layers can be used between the medial layer 30 and the substrate 12 (whether coated or uncoated) if needed and desired as determined by routine preliminary research.

Figure 3:
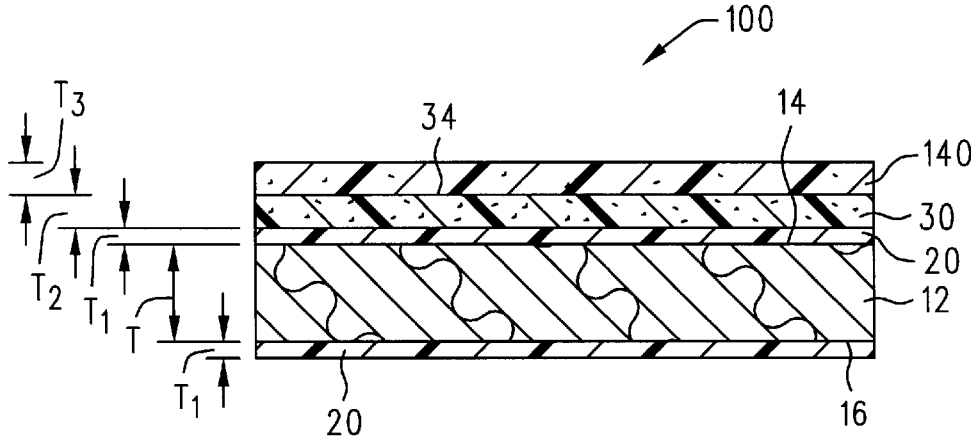
FIG. 3 is a schematically-illustrated and enlarged partial cross-sectional view of a completed print media product produced in accordance with a novel and preferred alternative embodiment of the invention illustrating the material layers and thicknesses associated therewith.

All of the embodiments described herein and shown in FIGS. 1–3 are basically "one-sided" with the medial layer 30 and layer(s) thereover being located on only one side of the substrate 12 (e.g. the coating layer 20/upper surface 14). Nonetheless, other embodiments encompassed within this invention may involve placement of the foregoing layers on either or both sides of the substrate 12 if needed and desired without limitation. In this regard, use of the phrase "on the substrate" or "over and above the substrate" when describing the layering arrangements of this invention shall encompass both "one-sided" and "dual-sided" media sheets with such language incorporating situations in which the subject layers are placed on either or both sides of the substrate 12. However, if a substrate 12 is employed which includes a coating layer 20 thereon as discussed herein, the medial layer 30 and remaining layer(s) thereover are optimally placed on the side or sides of the substrate 12 that are coated with the layer 20.

From a functional standpoint, the medial layer 30 is designed to provide a high degree of "capacity" (e.g. ink-retention capability) in connection with the media product 10, to facilitate rapid drying of the printed, image-containing media product 10, the creation of a media product 10 with a smooth/even surface, and to otherwise ensure that the desired gloss characteristics are maintained in the finished product. To accomplish these goals, the medial layer 30 is optimally porous and generally non-swellable in the presence of liquids, with the term "porous" being basically defined in a conventional fashion as recited above to involve a structure or material having a plurality of pores therein through which fluids, etc. may pass. The transfer of fluids including ink and the like into and through the medial layer 30 will occur via physical phenomena normally associated with porous materials including capillary action and the like. The medial layer 30 will have a representative and non-limiting uniform thickness "$T_2$" along its entire length of about 1–50 $\mu$m although this range may be varied as necessary. The primary ingredients used to fabricate the medial layer 30 include (1) at least one pigment (namely, a material used to impart color, opacity, and the like to a given formulation); and (2) and at least one binder (e.g. a composition having the ability to chemically, physically, and/or electrostatically retain one or more materials together in a given formulation or structure in order to provide mechanical strength, cohesiveness, and the like). While it is preferred that the medial layer 30 only employ the-two components listed above for the sake of simplicity and maximum effectiveness, it shall be understood that other ingredients incorporated within the medial layer 30 in variable quantities including but,not limited to fillers, surfactants, light-stabilizers, preservatives (e.g. antioxidants), general stabilizers, and the like (along with mixtures thereof) without limitation. While these additional components may be contained within the medial layer 30, they should be considered optional and employed as desired based on routine preliminary testing.

A preferred pigment composition shall involve the use of silica ($SiO_2$) which, in the current embodiment, has been determined to be most desirable and able to provide best results. Specific benefits associated with the particular use of silica in the medial layer 30 include but are not limited to the ability of this material to provide better light-stability (as defined above), higher pore volume, rapid drying times, a smooth and uniform surface in connection with the overall print media product 10, and a suitable degree of ink-retention capability. Silica is able to offer these benefits in a highly effective manner. Representative and non-limiting silica materials which are preferably employed in connection with the medial layer 30 involve the application and use of silica gel. Silica gel compositions are typically fabricated by combining mineral acid materials with silicates (sodium silicate and the like). The resulting product consists of an aggregated network-type structure within a liquid medium. Upon drying, a porous product is generated with a plurality of interstitial spaces and zones therein. While the claimed invention (with particular reference to the medial layer 30) shall not be restricted to any types or grades of silica, a representative silica gel composition suitable for use therein will have an exemplary/preferred mean silica particle size (e.g. diameter) of about 0.3–0.4 $\mu$m in water and an exemplary/preferred mean porosity of about 0.8–0.9 cc/g which provides excellent results. This particular silica material is commercially available from, for example, Grace Davidson, Inc. of Columbia, MD (USA) under the product designation "GD009B". While it is desired and preferred that silica be employed as the sole pigment in the medial layer 30 of the current novel embodiment, it is contemplated that other pigments may also be-used in addition to or in place of the silica including but, not limited to aluminum oxide, magnesium oxide, magnesium carbonate, calcium carbonate, pseudo-boehmite, mixtures thereof, and others. However, the employment of a silica +binder medial layer 30 in combination with the other material layer(s) discussed in this section constitutes a unique embodiment which provides unexpectedly superior results and is therefore preferred.

Combined with the pigment material(s) discussed above (preferably silica) is at least one binder (also referred to herein as a "primary binder") which is optimally of a water-soluble or water-dispersible organic polymer type. As previously stated, in the current embodiment and all other embodiments of the present invention, the term "primary binders" (or "primary binder") shall be used in connection with the binder materials employed in the medial layer 30 while "secondary binders" (or "secondary binder") shall involve the binder compounds incorporated within the top layer (discussed below). While a number of different primary binders alone or in combination can be employed within the medial layer 30, highly effective results are achieved through the use of polyvinyl alcohol as the sole primary binder in the medial layer 30. The primary binder provides a number of important functions including adhesion of the pigment materials (e.g. silica) together in a cohesive fashion, adhesion of the medial layer 30 to the substrate 12, and others. Polyvinyl alcohol is especially preferred for use as the sole primary binder formulation in the medial layer 30 because it provides, for example, excellent adhesion characteristics between the medial layer 30 and the substrate 12, good water-resistance, high efficiency at binding the pigment (e.g. silica) particles to each other, and a considerable degree of durability/structural integrity in the final printed media product 10.

Polyvinyl alcohol generally has the following structural formula: $(—CH_2CHOH—)_x$ [wherein x=about 1–3000 in a representative, non-limiting, and preferred embodiment], and is commercially available from numerous sources including but not limited to Nippon Gohsei of Japan under the product designation "GOHSENOL NH-26". While it is desired and preferred that polyvinyl alcohol be employed as the sole primary binder in the medial layer 30 of the current embodiment combined with silica, it is contemplated that other primary binders may also be used in addition to or in place of polyvinyl alcohol including but not limited to starch, SBR latex, gelatin, alginates, carboxycellulose materials, polyvinyl pyrrolidone, casein, polyethylene glycol, mixtures thereof, and others. However, the employment of a pigment (particularly silica) +polyvinyl alcohol mixture in:the medial layer 30 combined with the other material layer(s) discussed in this-section constitutes a particularly novel development which provides unexpectedly superior results and is therefore preferred as previously stated.

While the claimed invention shall not be restricted to any particular numerical quantities in connection with the ingredients in the medial layer 30 and other layer(s) associated with this invention, a preferred embodiment designed to provide optimum results will involve the use of a medial layer 30 having the following pigment and primary binder quantities: about 67–87% by weight pigment (e.g. silica) with about 77% by weight being preferred, and about 13–33% by weight primary binder (e.g. polyvinyl alcohol) with about 23% by weight being preferred. Should any additional/optional ingredients be employed within the medial layer 30, the relative quantities of the pigment(s) and primary binder(s) recited above would be proportionately reduced to account for any added components. Alternatively, instead of reducing the amounts of both the pigment(s) and binder(s), either one of the pigment(s) or binder(s) could be reduced in quantity on an individual basis to account for the added ingredient(s) if desired, depending on the type of print media product 10 being produced. Unless otherwise stated herein (and as discussed above), all percentage figures describing the material content of the various layers discussed in the claims, Summary of the Invention, and Detailed Description of Preferred Embodiments sections shall involve "dry weight", namely, the weight of the chosen component in the dried material layer of interest. Likewise, as previously noted, the claimed invention shall not be restricted to any given material quantities in connection with a given layer, with such quantities being subject to variation as needed and desired in accordance with routine preliminary testing. The preferred and non-limiting percentage figures listed herein for all of the ingredients employed in the various layers of this invention shall optimally represent values which reflect the total amount of the ingredient under consideration whether a single composition is employed or multiple compositions in combination are used. For example, the representative 23% by weight primary binder value recited above shall involve a situation where 23% by weight of a single primary binder may be employed or multiple primary binders in combination can be used which collectively constitute (as a total) 23% by weight of the dried medial layer 30.

Finally, a number of different methods may be employed to apply or otherwise deliver the medial layer 30 in position over and above the substrate 12 (and/or coating layer 20 associated therewith if present). Representative application techniques which can be used for this purpose include but are not limited to application of the pigment +primary binder mixture by using a conventional slot-die processing system, myer bar apparatus, or other comparable methods including those that employ circulating and non-circulating coating technologies. An exemplary coating weight range associated with the media layer 30 (irrespective of the coating method that is employed) is about 17–27 g/m$^2$ (optimum=about 22 g/m$^2$). However, the claimed invention and its various embodiments shall not be restricted to any particular layer application/formation methods (and coating weights) with a number of different techniques being employable for this purpose. Following application of the medial layer 30 onto the substrate 12 (and/or coating layer 20 associated therewith), the medial layer 30 is preferably dried prior to the next processing step. This may be accomplished by heating the substrate 12/layer 30 combination at a preferred and non-limiting temperature of about 80–120° C. within a conventional oven-type heating apparatus of a variety normally used for fabricating sheet-type print media products, with the foregoing substrate 12/layer 30 combination moving through the heating apparatus at a representative "web speed" of about 50–150 ft/minute. However, it shall also be understood that other drying methods may be employed without limitation provided that the layer 30 is effectively dried at this stage.

Prior to applying the next layer in the print media product 10, an optional intermediate step may be implemented which will now be discussed. This step (as schematically illustrated in FIG. 1) involves the delivery of a supply of an aqueous citric acid solution 32 uniformly over all or part of the top surface 34 of the medial layer 30 preferably after the medial layer 30 is dried so that at least part of the top surface 34 thereof is re-wetted. In an exemplary and non-restrictive embodiment, the solution 32 will contain about 0.7% by weight citric acid in water (with the foregoing % by weight value in this instance not involving "dry weight" as discussed above since an aqueous solution is involved). Regarding the amount of solution 32 that is delivered, any quantity will be adequate provided that a sufficient supply is delivered to uniformly wet the top surface 34 of the medial layer 30 over its entire length and width or in the desired particular locations thereon. However, in a representative and non-limiting example designed to provide effective results, 1 kg of completed 0.7% by weight citric acid solution as discussed above will be used (e.g. uniformly applied) per 500 ft$^2$ of the medial layer 30, although other quantities may again be employed as determined by routine preliminary testing. The purpose of this step is to avoid bubble formation in the next layer to be applied which is effectively accomplished using the above-listed citric acid solution 32. As a result, it is further ensured that the next layer (namely, the "top layer") will have a uniform consistency which facilitates proper image formation.

With continued reference to FIGS. 1–2, the next step in the fabrication process involves the delivery/placement of a "top layer" 40 in position over and above the medial layer 30 in order to form the preferred two-layer print media product 10 illustrated in the drawing figures. In an exemplary and non-limiting embodiment, the top layer 40 is designed and configured for use as the outermost layer of material which is the first layer to receive ink materials after expulsion from the selected printing system. It is also contemplated that one or more additional layers of material could be placed over and above the top layer 40 if needed and desired although the embodiment shown in FIGS. 1–2 is preferred. Likewise, the top layer 40 is optimally configured for direct attachment to the medial layer 30 as illustrated, with the term "direct attachment" being defined above to involve affixation of the top layer 40 to the medial layer 30 without any intervening material layers therebetween. In this manner, the number of material layers employed in the print media product 10 can be minimized, with the completed product 10 containing only two coating layers (FIGS. 1–2). It should also be understood that one or more intervening material layers could be used between the top layer 40 and the layers/compositions thereunder (including the medial layer 30) if needed and desired although the two-layer structure discussed herein is again preferred.

From a functional standpoint, the top layer 40 is designed to provide a high-gloss character to the print media product 10 and to likewise ensure the generation of clear and distinct images with superior quality levels, rapid drying times, and a permanent/stable character. In this regard, the top layer 40 is optimally high-gloss, non-porous, and generally swellable in the presence of liquids, with the term "non-porous" being basically defined in a conventional fashion to involve a structure or material lacking a plurality of pores therein through which fluids, etc. may pass. The transfer of fluids including ink and the like into and through the top layer 40 occurs via physical phenomena normally associated with non-porous materials including non-capillary absorption and the like. Accordingly, use of the non-porous top layer 40 in the print media product 10 will create a "substrate:porous:non-porous" layering arrangement which is highly effective in generating clear, stable, and fast-drying print media materials. Likewise, the two-layer design discussed herein which employs the medial layer 30 and top layer 40 thereon (with the top layer 40 being the first to receive ink materials) is particularly unique in terms of simplicity, functionality, and versatility.

The top layer 40 in the present embodiment is especially unusual (with particular reference to the use of layer 40 with a medial layer 30 of silica +primary binder thereunder in a two-layer media system). Specifically, top layer 40 preferably involves a structure consisting essentially of one or more (e.g. at least one) binder materials (also characterized herein as "secondary binders"). In accordance with the phrase "consisting essentially of" in the presently-described embodiment, the top layer 40 will not contain therein any pigments or fillers (of a particulate or non-particulate nature)

in more than negligible/trace quantities (for example, those quantities that would incidentally be present as a result of the manufacturing processes being employed). In other words, the top layer 40 in the current embodiment will not include any pigments or fillers therein aside from minute, trace amounts that would be considered inconsequential. Likewise, as a general proposition, the top layer 40 in this embodiment will not contain therein any composition(s) that would materially affect or alter the high-gloss character and/or non-porous nature of the top layer 40 (for instance, to make it more porous or porous in general). In the present embodiment (which, while preferred and novel, shall not be considered the only embodiment in this case), it is therefore desired that the top layer 40 be fabricated so that it is "binder-only" from a material-content standpoint (e.g. 100% by weight of one or more secondary binder materials). However, in accordance with the definitions listed above, it is possible that additional materials (namely, preservatives [e.g. antioxidants], surfactants, and others) may be incorporated within the top layer 40 as needed and desired provided that they again fit within the foregoing definitions. The term "binder" shall again generally involve compositions that have the ability to chemically, physically, and/or electrostatically retain one or more materials together in a given formulation or structure in order to provide mechanical strength, cohesiveness, and the like. Not only do the secondary binders in the top layer 40 enable proper adhesion of the top layer 40 to the materials thereunder, but likewise allow the non-porous, high-gloss character of the top layer 40 to be achieved. As previously noted, each binder material employed in the top layer 40 shall be characterized herein for convenience purposes as a "secondary binder" with such term also encompassing multiple binder compositions (e.g. a plurality of "secondary binders" or "secondary binder compositions"). With reference to the schematic illustration of FIG. 2, the top layer 40 will optimally have a uniform thickness "$T_3$" (FIG. 2) of about 1–20 $\mu$m, with this range being subject to change as needed and desired. The foregoing range will likewise encompass situations in which one secondary binder or a plurality of secondary binders are employed in combination. In a preferred, optimum, and non-limiting embodiment designed to facilitate the main goals of the top layer 40 in an especially effective manner (including the promotion of a non-porous, high-gloss character), a plurality of secondary binders (e.g. two or more) are employed within the top layer 40 (and nothing else), with each of the selected secondary binders being different. A number of different secondary binders alone or in combination may be employed without restriction. However, it has been discovered that unexpectedly effective results are obtained from the use of three very special and distinctive secondary binder classes and materials in combination. Specifically, such classes (and a preferred composition within each class) are as follows: (1) Secondary Binder No. 1: a polyvinyl alcohol (particularly, acetoacetylated polyvinyl alcohol); (2) Secondary Binder No. 2: a polyurethane (particularly, a modified polyurethane resin dispersion); and (3) Secondary Binder No.3: a polyamide resin (particularly, an epichlorohydrin-containing polyamide). Regarding Secondary Binder No. 1, the basic formula for polyvinyl alcohol was listed above. Exemplary and non-limiting derivatives of polyvinyl alcohol which may be encompassed within the "polyvinyl alcohol" class of materials that are suitable for use in the top layer 40 include but are not limited to unsubstituted polyvinyl alcohol as illustrated and discussed above, carboxylated polyvinyl alcohol, sulfonated polyvinyl alcohol, acetoacetylated polyvinyl alcohol, and mixtures thereof. However, it has been determined that acetoacetylated polyvinyl alcohol is preferred for use in the current embodiment and provides excellent results. Acetoacetylated polyvinyl alcohol has the following basic structural formula: $(—CH_2CHOH—)_x(—CH_2CHOCOCH_2COCH_3—)_y$ [wherein x=about 1–3000 and y=about 1–100 in a representative, non-limiting, and preferred embodiment]. This material is particularly useful and desired in the top layer 40 because of its high degree of affinity for the chemical dyes that are normally used in thermal inkjet formulations and its excellent level of gloss-control, as well as its ability to offer effective image permanence, light-stability, and water-resistance (e.g. water-fastness as previously defined). While acetoacetylated polyvinyl alcohol is commercially available from numerous sources, it may be obtained from, for example, Nippon Gohsei of Japan under the product designation "GOHSEFIMER Z 200". However, the present invention shall not be exclusively limited to this material which is recited for example purposes as a preferred and highly effective secondary binder.

With reference to Secondary Binder No. 2in the current embodiment, exemplary and non-limiting polyurethanes which may be encompassed within this class of materials include but are not limited to the sub-class of compositions which would involve water-soluble or water-dispersible polyurethane polymers, water-soluble or water-dispersible modified polyurethane resin dispersions, and mixtures thereof. However, it has been determined that the use of at least one modified polyurethane resin dispersion is preferred for employment as a secondary binder in the current embodiment and provides excellent results. The term "modified polyurethane resin dispersion" shall be generally defined herein to involve polyurethane polymers having hydrophobic groups associated therewith, wherein such materials are water-dispersible. This type of composition is particularly useful and desired in the top layer 40 because of its ability to provide good water-resistance, a high degree of light-stability (e.g. light-fastness), and fast drying times. While many different modified polyurethane resin dispersions are commercially available from numerous sources (and are typically proprietary in nature), a modified polyurethane resin dispersion that is particularly useful and effective in the present invention as a secondary binder in the top layer 40 involves a product sold by Dainippon Ink and Chemicals/Dainippon International (USA), Inc. of Fort Lee, N.J. (USA) under the product designation "PATELACOL IJ-30". Further general information regarding this type of material (with particular reference to polyurethane dispersions/emulsions) is provided in Japanese Pat. Publication No. 10-181189 which is incorporated herein by reference.

However, the claimed invention shall not be exclusively limited to the foregoing specific material which is recited for example purposes as a preferred embodiment designed to provide optimum results.

Finally, regarding Secondary Binder No. 3 in the top layer 40 of the print media product 10, exemplary and non-limiting polyamide resins which may be encompassed within this class of materials include but are not limited-to acrylic modified polyamides, acrylic polyamide copolymers, methacrylic modified polyamides, cationic polyamides, polyquaternary ammonium polyamides, epichlorohydrin-containing polyamides, and mixtures thereof. However, it has been determined that an epichlorohydrin-containing polyamide is preferred for use in the current embodiment and provides excellent results. The term "epichlorohydrin-containing polyamide" shall be generally defined herein to involve an epichlorohydin group-containing polyamide formulation, with this composition having the following basic structural/chemical formula: $(C_6H_{10}O_4 \cdot C_4H_{13}N_3 \cdot C_3H_5ClO)_x$ [wherein x=about 1–1000 in a representative, preferred, and non-limiting formulation]. This type of material is particularly useful and desired in the top layer 40 because of its ability to provide a high level of ink/dye retention and affinity, along with rapid drying times. While epichlorohydrin-containing polyamides are commercially available from numerous sources, an epichlorohydrin-containing polyamide that is particularly useful and effective in the present invention as a secondary binder in the top layer 40 may be obtained from, for example, Georgia Pacific Resins, Inc. of Crossett, Ark. (USA) under the product designation "AMRES 8855". However, the present invention shall not be exclusively limited to this material which is being provided for example purposes as a preferred and highly effective secondary binder. It should also be understood that, in a still further novel embodiment, the three specific secondary binders recited above, namely, a polyvinyl alcohol (particularly, acetoacetylated polyvinyl alcohol), a polyurethane (particularly, a modified polyurethane resin dispersion), and a polyamide resin (particularly, an epichlorohydrin-containing polyamide) could be employed in combination within the top layer 40 along with other compositions such as pigments, fillers, and the like without restriction. However, the embodiment recited above which consists essentially of binders is again preferred.

All of the secondary binders selected for use in the top layer 40 preferably involve water-soluble or water-dispersible organic polymers. While the top layer 40 shall not be restricted in connection with the types of secondary binders that are employed, the number of secondary binders being used, and/or the relative quantities of such binders, the special combination of secondary binders outlined above constitutes a novel development in terms of material-content, effectiveness in generating a non-porous, high-gloss ink-receiving top layer 40, and the like. As previously stated, it is preferred that the top layer 40 be approximately 100% by weight secondary binder (whether a single secondary binder is employed or multiple secondary binders are used in combination). In situations involving the use of multiple secondary binders together in a-mixture, the relative percentages thereof will be readily determined using routine preliminary experimentation. However, in the above-listed embodiment, representative amounts of Secondary Binder Nos. 1–3 are as follows: about 74–94% by weight Secondary Binder No. 1 (e.g. a polyvinyl alcohol, optimally, acetoacetylated polyvinyl alcohol) with about 84% by weight being preferred, about 5–15% by weight Secondary Binder No. 2 (e.g. a polyurethane, optimally, a modified polyurethane resin dispersion) with about 10% by weight being preferred, and about 1–12% by weight Secondary Binder No. 3 (e.g. a polyamide resin, namely, an epichlorohydrin-containing polyamide) with about 6% by weight being preferred. It should again be noted and understood that, unless otherwise stated herein, all percentage figures describing the material content of the various layers discussed in the claims, Summary of the Invention, and Detailed Description of Preferred Embodiments sections shall involve "dry weight", namely, the weight of chosen component in the dried material layer of interest. Likewise, the present invention shall again not be restricted to any given material quantities in connection with a particular layer or layers in the claimed print media products, with such quantities being subject to variation as needed and desired in accordance with routine preliminary testing.

As noted herein, the top layer 40 shown in the embodiment of FIGS. 1–2 initially receives ink materials from the printing system of interest. Beceause the top layer 40 in the present embodiment preferably consists entirely or essentially of water-soluble or water-dispersible secondary binder materials as discussed above, the top layer 40 will again be non-porous with a high-gloss character. Ink materials (including the various pigments, colorants, etc. listed earlier in this discussion) that are delivered from the chosen printing system to the top layer 40 travel within and through the top layer 40 by virtue of the "swelling" of this structure and consequent absorption of the ink. Next, the ink materials pass (primarily by capillary action) into and through the porous medial layer 30, with the combination of these steps resulting in the generation of stable, clear, and fast-drying printed images. While it is desired and preferred that the above-listed specific secondary binder materials be employed as the exclusive binder compounds within the top layer 40, it is contemplated that other secondary binders may also be used in addition-to or in place of the secondary binders and secondary binder classes recited above. These other secondary binders include but are not limited to starch, SBR latex, gelatin, alginates, carboxycellulose materials, polyvinyl pyrrolidone, casein, polyethylene glycol, mixtures thereof, and others. However, the employment of a top layer 40 produced from a novel mixture of the particular secondary binders recited above (namely, Secondary Binder Nos. [1]–[3]) is particularly unique in the present invention and provides excellent results.

Finally, a number of different methods may be employed to place or otherwise deliver the top layer 40 in position over and above the medial layer 30. Representative application techniques which can be used for this purpose include but are not limited to delivery of the top layer 40 by conventional cascade or cast coating methods. A representative coating weight range associated with the top layer 40 (irrespective of the coating method that is chosen) is about 5–13 g/m$^2$ (optimum=about 9 g/m$^2$). However, the claimed invention shall not be restricted to any particular layer application methods (and coating weights) with a number of different techniques being employable for this purpose. Following application of the top layer 40 as discussed above, the print media product 10 is preferably dried by heating the product 10 at a preferred and non-limiting temperature of about 80–120° C. within a conventional oven-type heating apparatus of a variety normally used for fabricating sheet-type print media products, with the print media product 10 moving through the heating apparatus at a representative "web speed" of about 50–150 ft/minute. However, it shall also be understood that other drying methods may be employed without limitation provided that the print media product 10 is effectively dried at this stage.

At this point, preparation of the print media product 10 is completed. From a physical, chemical, and structural standpoint, the print media product 10 will have the following important characteristics: an average (e.g. complete) drying time of less than about three (3) minutes and a specular gloss of >60 at 20° (as measured by a Micro-TRI-Gloss meter [P/N GB45201]from BYK Gardner USA of Columbia, Md. [USA]), with the foregoing numerical parameters being non-limiting but preferred. The resulting product 10 may again be varied in construction as outlined above, with the understanding that the foregoing preferred embodiments are non-restrictive yet represent highly novel structures that are capable of offering multiple benefits in combination. The following specific Example is provided as a preferred version of the print media product 10 that is designed to deliver optimum results. It shall be understood that the recitation of this Example will not limit the invention in any respect.

EXAMPLE 1

In this Example, the substrate 12 is constructed from paper coated on both surfaces/sides 14, 16 with a coating layer 20 of polyethylene. The thickness values associated with the substrate 12, medial layer 30, and top layer 40 are within the ranges specified above.

TABLE A

| Medial Layer | | |
|---|---|---|
| Component | Class of Material | % By Dry Weight in Layer |
| Silica | Pigment | 77 |
| Polyvinyl alcohol | Primary Binder | 23 |
| | | 100 |

TABLE B

| Top Layer | | |
|---|---|---|
| Component | Class of Material | % By Dry Weight in Layer |
| Acetoacetylated Polyvinyl Alcohol | Secondary Binder | 84 |
| Modified Polyurethane Resin Dispersion | Secondary Binder | 10 |
| Epichlorohydrin-Containing Polyamide | Secondary Binder | 6 |
| | | 100 |

In accordance with the present invention, a still further embodiment exists which will now be discussed. It shall be understood that all of the information, materials, parameters, functional attributes, construction materials, and other data (numerical and otherwise) concerning (1) the substrate 12; and (2) the medial layer 30 as discussed above in connection with the first embodiment are directly applicable to the currently-described alternative embodiment unless otherwise stated herein. In this regard, all of the information presented above regarding the first embodiment illustrated in FIG. 2 is incorporated by reference in the present discussion relative to the current embodiment shown in FIG. 3 (and FIG. 1). In FIG. 3, an alternative print media product is provided which is designated at reference number 100. All of the components and elements having common reference numbers in FIGS. 2 and 3 represent items that are fully applicable to both media sheets (namely, print media products 10, 100). The primary distinction between the first and second embodiments involves the material-content of the top layer which will now be discussed. This layer is identified at reference number 40 in print media product 10 and at reference number 140 in print media product 100. The top layers 40, 140 in both embodiments may, in fact, be the same from a secondary binder-standpoint, with all of the above-listed information regarding representative secondary binders, secondary binder types/classes, secondary binder mixtures, etc. that are used in print media product 10 being applicable to the current embodiment and incorporated herein by reference. However, in the embodiment of FIG. 3, an additional ingredient is employed in combination with the secondary binder or binders in the top layer 140, namely, a small quantity of one or more pigments. While the current embodiment shall not be restricted to any given pigment material or materials for this purpose, the use of silica is preferred (e.g. of the "precipitated" variety in an exemplary and non-limiting manner). Precipitated silica materials are generally defined to involve silica products that are prepared by combining mineral acid compositions with sodium silicates. During production, these reactants are suitably mixed using shearing forces which yield a product characterized by multiple groups of combined particles. This material (e.g. silica) is then used to create a "satin"-type, "semi-gloss" top layer 140 compared with the high-gloss character of the previous embodiment. Such a semi-gloss product is appropriate and useful in many different applications including those where a "matte" finish is desired. Precipitated silica compositions that are suitable for use in the top layer 140 of the print media product 100 are available from numerous commercial sources including but not limited to Degussa Corporation (Performance Materials Group) of Ridgefield Park, N.J. (USA) under the product designation "SIPERNAT 310". Likewise, while precipitated silica is preferred in this embodiment, other forms of silica may also be employed to yield the desired semi-gloss character discussed above.

A novel feature of the embodiment illustrated in FIG. 3 involves the use of a specific and highly-controlled quantity of the foregoing pigment. While the amount of pigment (e.g. silica) in the medial layer 30 is relatively high as discussed above and is greater than the quantity of binder being used, the top layer 140 in the current embodiment shall not exceed about 10% by weight pigment (e.g. silica) with the term "% by weight" as used herein involving the dry weight of the dried top layer 140. This special weight parameter not only preserves and retains the benefits of the binder(s) employed in the top layer 140 from a non-porosity standpoint, but likewise adds a semi-gloss, satin-type character to this structure. In other words, by carefully controlling the amount of pigment,(namely, silica) to be not more than about 10% by weight of the top layer 140, the layer 140 can maintain its non-porous character which is beneficial for the important reasons given above while also exhibiting a semi-gloss, satin-type finish. This development in combination with the specialized medial layer 30 discussed herein which contains a pigment (optimally silica) and a binder (preferably polyvinyl alcohol) creates a highly unique and distinctive print media product 100 having multi-functional capabilities. It is especially important that these multiple capabilities are provided using only two material layers 30, 140 on the substrate 12. Accordingly, the second embodiment of the claimed invention likewise represents a significant advance in the art of print media technology from a structural and functional perspective.

While it is desired and preferred that silica be employed as the sole pigment in the top layer 140 of the current embodiment, it is contemplated that other pigments may also be used in addition to or in place of the silica including but not limited to aluminum oxide, magnesium oxide, magnesium carbonate, calcium carbonate, pseudo-boehmite, mixtures thereof, and others. However, the specific use of one or more secondary binders combined with not more than about 10% by weight silica in the top layer 140 which is positioned on the medial layer 30 represents a novel and unique embodiment that provides excellent results.

Since all of the numerical information and other data associated with the substrate 12 and medial layer 30 in the embodiment of FIG. 3 are substantially the same as that encompassed within the embodiment FIG. 2, this information and data will not be repeated. However, to account for the presence of a pigment (notwithstanding the small quantity thereof) in the top layer 140 of the current embodiment, it is preferred that the amount of secondary binder (or binders) be reduced in some fashion. The claimed invention shall not be restricted to any particular secondary binder or binders that are decreased in quantity which may vary depending on the types of secondary binders under consideration and whether multiple binders are employed. In a representative and non-limiting version of the invention where a plurality of secondary binder compositions are employed (e.g. Secondary Binder Nos. [1]–[3]), a reduction is made in the amount of the secondary binder which, in the absence of any pigment, would be present in the greatest quantity. In the print media product 100 where Secondary Binder Nos. [1]–[3] are used, this would involve Secondary Binder No. 1 (e.g. a polyvinyl alcohol, namely, acetoacetylated polyvinyl alcohol), with the reduction in this material equaling the amount of added pigment (e.g. silica). Accordingly, in the current example, the following representative quantities would be applicable: about 68–88% by weight Secondary Binder No. 1 (e.g. a polyvinyl alcohol, optimally, acetoacetylated polyvinyl alcohol) with about 78% by weight being preferred, about 5–15% by weight Secondary Binder No. 2 (e.g. a polyurethane, optimally, a modified polyurethane resin dispersion) with about 10% by weight being preferred, about 1–12% by weight Secondary Binder No. 3 (e.g. a polyamide resin, namely, an epichlorohydrin-containing polyamide) with about 6% by weight being preferred, and about 2–10% by weight pigment (e.g. silica) with about 6% by weight being preferred. Again, all of the percentage figures recited above represent dry weight values (namely, the weight of the ingredient under consideration on a percentage basis as part of the overall dried top layer 140).

As a further note concerning this embodiment, additional materials (surfactants, preservatives, etc.) may likewise be incorporated within both the medial and top layers 30, 140 as needed and desired. However, with reference to the top layer 140, it is preferred that no additional particulate or other compositions be employed therein including fillers, etc. (aside from the not more than about 10% pigment quantity and at least one secondary binder). Alternatively, if various other ingredients are added, it is preferred that they be of a type which would not materially affect or alter the semi-gloss character and/or non-porous nature of the top layer 140 (for instance, to make it more porous or porous in general). In this regard, it is further preferred in a non-limiting fashion that the top layer 140 in the current embodiment consist entirely or essentially of at least one secondary binder and not more than about 10% by weight pigment (e.g. silica).

At this point, preparation of the print media product 100 is completed. From a physical, chemical, and structural standpoint, the print media product 100 will have the following important characteristics: an average (e.g. complete) drying time of less than about three (3) minutes, a specular gloss of about 29 at 60°, and a specular gloss of about 38 at 85° (as both measured by a Micro-TRI-Gloss meter [P/N GB4520] from BYK Gardner USA of Columbia, Md. [USA]), with the foregoing numerical parameters being presented in a non-limiting fashion. The following specific Example is provided as a preferred version of the print media product 100 that is designed to deliver optimum results. It shall be understood that the recitation of this Example will not limit the invention in any respect.

EXAMPLE 2

In this Example, the substrate 12 is constructed from paper coated on both surfaces/sides 14, 16 with a coating layer 20 of polyethylene. The thickness values associated with the substrate 12, medial layer 30, and top layer 40 are within the ranges specified above.

TABLE A

| Medial Layer | | |
|---|---|---|
| Component | Class of Material | % By Dry Weight in Layer |
| Silica | Pigment | 77 |
| Polyvinyl alcohol | Primary Binder | 23 |
| | | 100 |

TABLE B

| Top Layer | | |
|---|---|---|
| Component | Class of Material | % By Dry Weight in Layer |
| Acetoacetylated Polyvinyl Alcohol | Secondary Binder | 78 |
| Modified Polyurethane Resin Dispersion | Secondary Binder | 10 |
| Epichlorohydrin-Containing Polyamide | Secondary Binder | 6 |
| Silica | Pigment | 6 |
| | | 100 |

It should also be understood that all of the manufacturing and processing techniques discussed above in connection with the embodiment of FIG. 2 are equally applicable to and incorporated herein by reference relative to the embodiment of FIG. 3. In summary and from a general standpoint, the basic method of interest with reference to both of the foregoing embodiments will generally involve the following steps: (1) providing a substrate; (2) applying a medial layer in position over and above the substrate, with the medial layer being comprised of a pigment (e.g. silica) and at least one primary binder composition (e.g. polyvinyl alcohol); and (3) placing a top layer over and above the medial layer, with the top layer containing the particular ingredients recited above in connection with both embodiments. Numerous variations are again possible regarding this method which shall be encompassed within the claims provided below. In particular and as previously discussed, one optional step which may be employed between steps (2) and (3) in both embodiments involves delivering a citric acid solution 32 (e.g. about 0.7% by weight citric acid in a preferred and non-limiting version of the invention) onto part or (preferably) all of the top surface 34 of the medial layer 30 prior to placement of the top layers 40, 140 in position thereover. It has been discovered that the use of this particular solution 32 can again assist in avoiding undesired bubble formation in the top layers 40, 140, thereby ensuring that the top layers 40, 140 have a uniform consistency which facilitates proper image formation thereon.

Having herein set forth preferred embodiments of the invention, it is anticipated that various modifications may be made thereto by individuals skilled in the relevant art which nonetheless remain within the scope of the invention. For example, the invention shall not be limited to any particular ink delivery systems, operational parameters, numerical values, dimensions, ink compositions, layering arrangements, print media components, substrates, material proportions/quantities, and component orientations within the general guidelines set forth above unless otherwise stated herein. The present invention shall therefore only be construed in accordance with the following claims:

The invention that is claimed is:

1. A print media product comprising:

a substrate;

a medial layer positioned over and above said substrate, said medial layer being comprised of silica and at least one primary binder composition; and a top layer positioned over and above said medial layer, said top layer consisting of at least one secondary binder composition.

2. The print media product of claim 1 wherein said substrate is comprised of paper, said substrate further comprising a first side and a second side, at least one of said first side and said second side comprising a coating layer thereon comprised of polyethylene.

3. The print media product of claim 1 wherein said primary binder composition is comprised of polyvinyl alcohol.

4. The print media product of claim 1 wherein said secondary binder composition is comprised of a plurality of binder materials in combination, with each of said binder materials being different from each other.

5. A print media product comprising:

a substrate;

a medial layer positioned over and above said substrate, said medial layer being comprised of silica and polyvinyl alcohol; and a top layer positioned over and above said medial layer, said top layer being comprised of acetoacetylated polyvinyl alcohol, at least one modified polyurethane resin having a plurality of hydrophobic groups, and at least one epichlorohydrin-containing polyamide.

* * * * *